US005715214A

United States Patent [19]

Svarnias

[11] Patent Number: 5,715,214

[45] Date of Patent: Feb. 3, 1998

[54] ELECTRICAL TIMER WITH SETTING WINDOW

[75] Inventor: Ted N. Svarnias, Arlington Heights, Ill.

[73] Assignee: Intermatic Incorporated, Spring Grove, Ill.

[21] Appl. No.: 674,910

[22] Filed: Jul. 3, 1996

[51] Int. Cl.[6] ..... G04B 47/00; G04F 8/00; H01H 43/10; H01H 7/08

[52] U.S. Cl. ..... 368/10; 368/107; 200/35 R; 200/38 R; 200/38 D

[58] Field of Search ..... 368/10, 28, 107–113; 200/35 R, 37 R, 37 A, 38 R, 38 A, 38 FA, 38 BS, 38 B, 38 BA, 38 C, 38 D

[56] References Cited

U.S. PATENT DOCUMENTS

| | | | |
|---|---|---|---|
| D. 208,930 | 10/1967 | Johnson et al. . | |
| D. 210,474 | 3/1968 | Miley . | |
| D. 234,215 | 1/1975 | Felske . | |
| D. 241,524 | 9/1976 | Haggstrom . | |
| D. 246,159 | 10/1977 | Podall . | |
| D. 265,553 | 7/1982 | Joss et al. . | |
| D. 325,175 | 4/1992 | Tinz . | |
| D. 352,472 | 11/1994 | Chen . | |
| 2,545,617 | 3/1951 | Kaefer et al. . | |
| 3,548,125 | 12/1970 | Banathy et al. . | |
| 3,925,629 | 12/1975 | Albinger, Jr. . | |
| 3,997,742 | 12/1976 | Marquis . | |
| 4,029,918 | 6/1977 | Kah, Jr. | 200/38 D |
| 4,171,471 | 10/1979 | Boyles . | |
| 4,297,546 | 10/1981 | Koch | 200/38 R |
| 4,558,192 | 12/1985 | Thoma | 200/35 R |
| 5,400,302 | 3/1995 | Yamamoto et al. | 368/107 |

OTHER PUBLICATIONS

"More Power To You" catalogue, (selected pages showing timers), by Intermatic Incorporated, 1994.

*Primary Examiner*—Vit W. Miska

*Attorney, Agent, or Firm*—Brinks Hofer Gilson & Lione

[57] ABSTRACT

An electrical timer having scales for setting switching times and time-of-day. A window exposes only a portion of one of the scales thereby helping a user to set the time-of-day of the timer. In one aspect, the window is located in a cover that hides all but a portion of the time-of-day scale. According to a further aspect, the switching-times scale and the time-of-day scale are located on a dial rotatably mounted on a timer housing that includes a suitable electrical plug, an electrical receptacle, and an electrical switch operable with the scales.

22 Claims, 1 Drawing Sheet

ELECTRICAL TIMER WITH SETTING WINDOW

The present invention relates to electro-mechanical timers.

Electro-mechanical timers are common accessory appliances used in households and businesses. Electro-mechanical timers are a type of electrical timer. One type of electro-mechanical timer plugs into a conventional electrical receptacle and provides a switched electrical receptacle into which another appliance, such as a lamp, radio, etc., can be plugged. The timer includes an internal switch that is connected in series to the electrical receptacle provided on the timer. The other appliance can be turned on and off automatically by means of the electro-mechanical timer.

The user sets the times at which the internal switch of the electro-mechanical timer operates to automatically turn on and off the electrical supply to the appliance plugged into the timer electrical receptacle. Electro-mechanical timers include various interfaces by which a user can set the desired switching times. For example, on some timers, the user sets pins with tabs around the periphery a 24-hour dial to indicate the desired switching times. Other types of timers have microprocessors and use input and display panels (e.g. LCD panels) to permit the user to set the desired switching times by means of menu prompts.

On many types of timers, the user may also be required to set a timer clock to the current time-of-day in order to begin proper operation of the timer. The timer clock operates on the electrical supply from the conventional electrical receptacle.

Although many of these types of timers work well, some consumers may become confused when setting the switching times and the time-of-day. Accordingly, it is an object of the present invention to provide an electro-mechanical timer that is easy to use. Further, it is an object of the present invention to provide an electro-mechanical timer that is easy for a consumer to set the desired switching times and the current time-of-day.

SUMMARY OF THE INVENTION

To achieve the foregoing and other objectives and in accordance with the purposes of the present invention, there is provided an electro-mechanical timer having scales for setting switching times and time-of-day. A window exposes only a portion of one of the scales thereby helping a user to set the timer by directing attention to that specific location. In a further aspect, the window is located in a cover that hides all but a portion of the time-of-day scale. According to a further aspect, the switching-times scale and the time-of-day scale are located on a dial rotatably mounted on a timer housing that includes a suitable electrical plug, an electrical receptacle, and an electrical switch operable with the scales.

DETAILED DESCRIPTION OF THE PRESENTLY PREFERRED EMBODIMENTS

Figure 1:
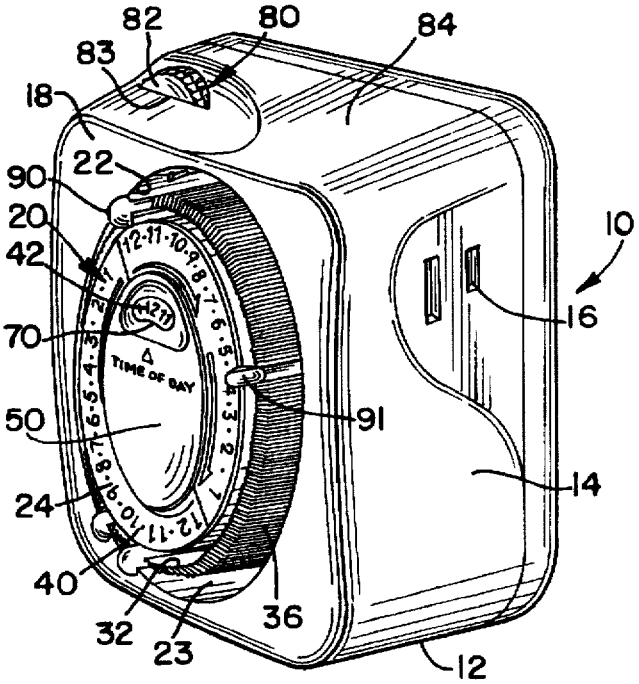
FIG. 1 is a perspective view of a timer according to a first embodiment of the present invention.
Figure 2:
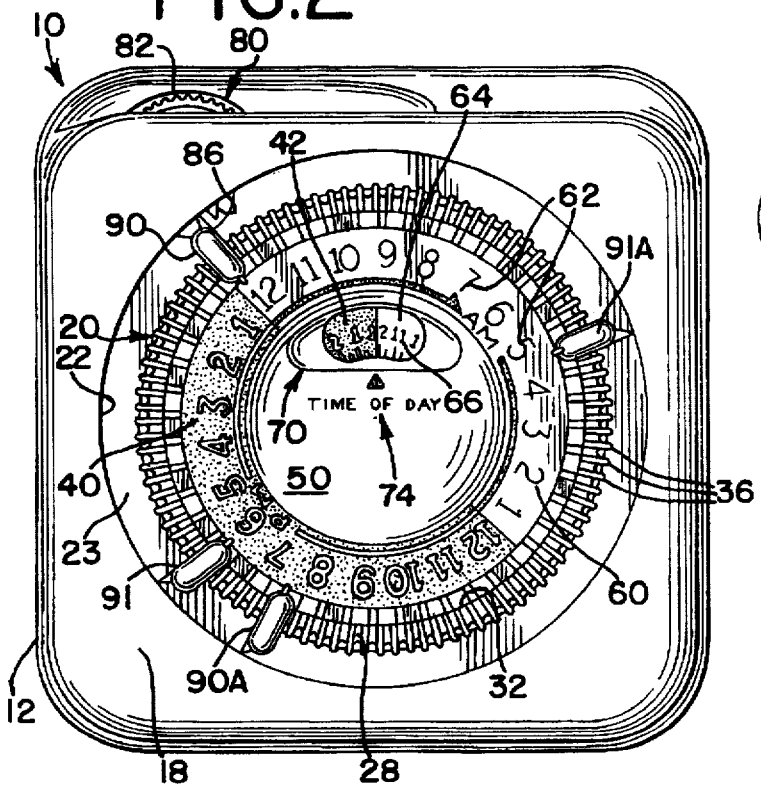
FIG. 2 is a front view of the timer shown in FIG. 1.

Referring to the FIGS. 1 and 2, a timer 10 is shown. The timer 10 includes a housing 12. On a rear side of the housing 12 (not shown), there is a conventional plug for insertion into a conventional electrical receptacle. The conventional plug may be of the 3-prong (grounded) type, or may be of the 2-prong type. In this embodiment, the plug is of the 2-prong type. Located on a side 14 of the housing 12 is an outlet receptacle 16. The outlet receptacle 16 is conventionally sized to permit an appliance, such as a lamp or radio, to be plugged thereinto.

Located on a front side 18 of the timer housing 12 is a dial 20. The dial 20 is mounted in the housing 12 so that it is rotatable thereto. In the embodiment shown, the dial 20 is mounted in a circular recess 22 in the front side 18 of the housing 12. The diameter of the circular recess 22 is larger than the diameter of the dial so that a circular channel 23 is defined around the outside circumference of the dial 20.

The dial 20 includes a front surface 24. Located on the front surface 24 adjacent to an outer circumferential edge 28 is a circumferential slot 32. A plurality of evenly spaced radial ribs 36 are located at the slot 32 and on the front surface 24 between the slot 32 and the edge 28. The ribs 36 extend around the outer circumferential edge 28 of the dial 20.

The front surface 24 of the dial 20 includes at least two portions: a first portion 40 and a second portion 42. The first portion 40 is located adjacent to, and radially inward from, the circumferential slot 32. The second portion 42 is located adjacent to the first portion 40, but radially inward from the first portion 40.

A cover 50 is located on the front side 18 of the timer 10 in front of the dial 20. The cover 50 is mounted so that it does not rotate relative to the housing 12, i.e. it is stationary relative to the housing 12. However, the dial 20, which is rotatably mounted relative to the housing 12, is also rotatably mounted relative to the cover 50. The cover 50 is sized to cover the second portion 42 of the front surface 24 of the dial 20. In the present embodiment, the cover 50 has a flat circular shape.

Located on the first portion 40 of the front surface 24 of the dial is a first time scale 60. The first time scale 60 is 24-hour time scale. The first time scale 60 includes indicia 62 to indicate the 24 hours of the day. The indicia 62 may range from "01:00" to "24:00" or may be divided into two halves, representing "A.M." and "P.M.", with each of the halves numbered from "1" to "12." Alternatively, other time scale representations may be used. The embodiment shown in FIGS. 1 and 2 uses this latter representation. The A.M. and P.M. halves may be distinctively marked, by means of shading for example, to permit a user to readily distinguish the A.M. half of the scale 60 from the P.M. half of the scale 60.

Located on the second portion 42 of the front surface 24 of the dial is a second time scale 64. The second time scale 64 may also be a 24-hour time scale. The second time scale 62 may also includes indicia 66 to indicate the 24 hours of the day. In a preferred embodiment, the second time scale 64 uses the same 24 hour range format as the first time scale 60, so that if the first time scale 60 is divided into two halves, representing "A.M." and "P.M.", the second scale 64 also uses two halves divided into "A.M." and "P.M."

As mentioned above, the cover 50 covers the second portion 42 of the front surface 24 of the dial 20. The cover 50 includes an opening or window 70. The window 70 exposes part of the second portion 42 of the front surface 24 and allows a portion of the second scale 64 to be observable through the window 70. Located adjacent to the window 70 on the cover 50 is a marking 74 to indicate "TIME OF DAY".

Figure 3:
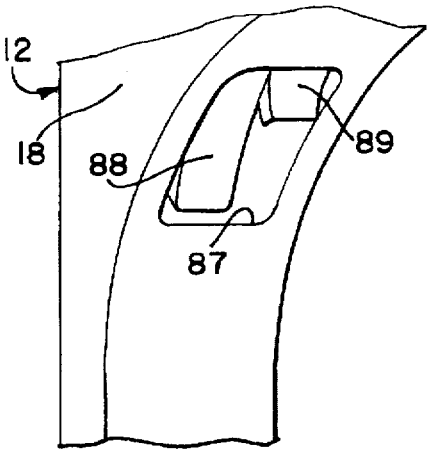
FIG. 3 is a perspective view of a portion of the recess in the front of the timer housing of FIG. 1 with the dial removed to show portions of the ratchet wheel teeth.

Located in the housing 12 is a switch actuator 80. The switch actuator 80 is mounted in the housing 12 so that a portion of a dial knob part 82 of the switch actuator 80 is manually accessible through an opening 83 on a top side 84 of the housing 12. The switch actuator 80 is mounted in the housing 12 so that the dial knob part 82 is rotatable thereto. Referring to FIGS. 2 and 3, the switch actuator 80 includes a toothed ratchet wheel 86 connected to the dial knob part 82. The teeth of the ratchet wheel 86 extend partially into the recess 22 in the front side 18 of the housing 12 through an opening 87 in the housing 12, as shown in FIG. 3. The ratchet wheel 86 includes two sets of ratchet wheel teeth. These two sets of ratchet wheel teeth are offset and staggered from each other. A first set of teeth 88 is located closer to the front side 18 of the housing 12 and the second set of ratchet wheel teeth 89 are located further from the front side 18 of the housing 12.

Figure 4A:
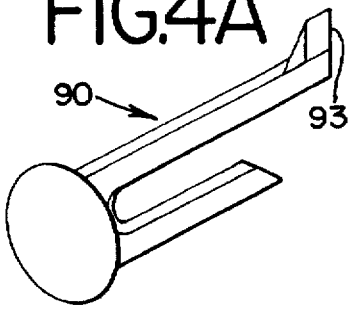
FIGS. 4A and 4B are perspective views of the pins shown in FIGS. 1 and 2.
Figure 4B:
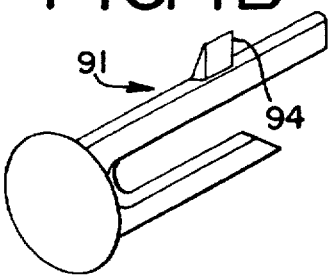

Referring again to FIGS. 1 and 2, to operate the timer 10, the user sets the times at which the appliance plugged into the receptacle turns on and turn off, the user uses an "ON"-switching pin 90 and an "OFF"-switching pin 91. Referring to FIGS. 4A and 4B, the "ON"-switching pin 90 and the "OFF"-switching pin 91 have a similar hook-like shape and are removable from the dial 20 so that they can be positioned at the desired locations along the dial periphery representing the times at which the appliance plugged into timer turns on and off. To set a time at which the appliance should turn on, the "ON"-switching pin 90 is inserted into the front surface 24 of the dial 20 so that one of the tines of the "ON"-switching pin 90 is in the slot 32 in the front surface 18. The ribs 36 help to position and secure the "ON"-switching pin 90. When inserted in this manner, a tab 93 of the "ON"-switching pin 90 extends radially beyond the circumferential edge rim 28 of the dial 20 into the channel 23. To set a time at which the appliance should turn off, the "OFF"-switching pin 91 is inserted into the front surface 24 of the dial 20 in a similar manner. When inserted in this manner, a tab 94 of the "OFF"-switching pin 91 extends radially beyond the circumferential edge rim 28 of the dial 20 into the channel 23. The tab 93 on the "ON"-switching pin 90 is located at a more inward position relative to tab 94 on the "OFF"-switching pin 91. If an additional switching time is desired, additional pairs of "ON"-switching and "OFF"-switching pins may be inserted into the dial at appropriate locations.

Referring to FIG. 2, the pins 90 and 91 are located in the slot 32 along the circumference of the dial 20 at the desired switching times, i.e. the times at which the user wishes the appliance plugged into the receptacle 16 to turn on and off. The pins 90 and 91 are inserted at the desired times using the first scale 60. For example, pin 90 is inserted at approximately 12:15 P.M. and pin 91 is inserted at approximately 6:00 P.M. A second pair of pins 90A and 91A have also been inserted into the dial 20 to set an "ON"-switching time at 7:30 P.M. and an "OFF"-switching time at 4:45 A.M.

After the switching times are set, the user sets the current time-of-day. To set the time-of-day on the embodiment of the timer shown in FIGS. 1 and 2, the user uses the second scale 66. The user rotates the dial 20 relative to the housing 12 so that the current time-of-day is visible on the second scale 66 through the window 70. Preferably, the current time-of-day is shown on the second scale 66 aligned with the marking 74 adjacent to the window 70.

After setting the switching times and the time-of-day, the timer 10 is plugged into a conventional wall outlet and the appliance is plugged into the receptacle 16. The dial knob 82 may be set to "ON" or "OFF" corresponding to the desired state of the receptacle 16. The switch knob 82 may be appropriately marked with indicia, e.g. "ON" and "OFF" to facilitate determining the state of the switch actuator 80. The switch actuator 80 is of the type so that rotation of the switch through a portion of a complete turn, e.g. an eighth turn, will turn the switch from an "ON" state to an "OFF" state and vice versa.

The dial 20 is connected to a conventional clock mechanism internal of the housing 12. The clock mechanism causes the dial 20 to make one full rotation every 24 hours. As the dial 20 rotates, the tabs 93 and 94 of the pins 90 and 91 come into contact with the teeth of the ratchet wheel 86. The tab 93 on the "ON"-switching pin 90 is aligned to contact the inner set of ratchet wheel teeth 89 and the tab 94 on the "OFF"-switching pin 91 is aligned to contact the outer set of ratchet wheel teeth 88. If the Switch actuator 80 is in an "OFF" state, one of the teeth of the inner wheel 89 will be extending into the recess 23. Thus, as the tab 91 of the "ON"-switching pin 90 passes, it will cause the switch actuator 80 to trip from an "OFF" state to an "ON" state. However, if the switch is already in an "ON" state, the tab 91 on the "ON"-switching pin 90 will not affect the state of the switch actuator 80, (i.e. the appliance plugged into the timer will remain "ON"). Similarly, the tab 94 on the "OFF"-switching pin 91 is aligned to contact the set of teeth on the outer ratchet wheel 88. If the switch actuator 80 is in an "ON" state, one of the teeth of the outer ratchet wheel 88 will be extending into the recess 23. Thus, as the tab 91 of the "OFF"-switching pin 91 passes, it will cause the switch actuator 80 to trip from an "ON" state to an "OFF" state. However, if the switch actuator 80 is already in an "OFF" state, the tab 93 on the "ON"-switching pin 90 will not affect the state of the switch actuator 80, (i.e. the appliance plugged into the timer will remain "OFF").

The timer 10 is very easy to use. The time scales 60 and 66 are clearly marked. In addition, the cover 50 hides most of the second scale 66, except for the small portion observable through the window 70. This helps direct a user to the proper portion of the second scale that is necessary to set the time-of-day and helps avoid confusion on the part of the user.

In alternative embodiments, the timer may have scales that are linear, or a shape other than circular. Also, other means may be used to set the switching times. For example, slidable tabs may be located along the dial instead of insertable pins. Also, the cover may cover either the first or the second scale or both. In the above embodiment, the cover is opaque, but in alternative embodiments, the cover may be transparent or translucent. In further alternatives, the cover may be provided by other means that hides a portion of one, of the scales, while focussing the user's attention on only a portion thereof.

It is intended that the foregoing detailed description be regarded as illustrative rather than limiting and that it is understood that the following claims including all equivalents are intended to define the scope of the invention.

I claim:

1. An improved timer control interface for an electrical timer used to turn on and off an electrical supply and wherein the interface is used to set desired switching times of the electrical timer and wherein the interface comprises a first timing scale and a second timing scale, and wherein the improvement comprises:

a surface covering a portion of said second scale, said surface having a window to permit observation of a portion of said second scale, whereby said switching times are set by utilization of one of said scales and time-of-day is set by utilization of the other of said scales.

2. The invention of claim 1 wherein said second timing scale is a current time-of-day scale.

3. The invention of claim 1 wherein said first timing scale and said second timing scale are located on a dial.

4. The invention of claim 1 wherein said first and said second scales are concentric to each other.

5. The invention of claim 1 wherein said surface is a circular-shaped cover.

6. The invention of claim 1 wherein said first timing scale and said second timing scale are rotatably mounted in a housing.

7. The invention of claim 1 wherein said second timing scale is rotatably mounted relative to said surface.

8. The invention of claim 1 further comprising a housing, and wherein said second timing scale is rotatably mounted relative to said housing.

9. The invention of claim 1 further comprising a housing, and wherein said surface is mounted in a fixed relationship relative to said housing.

10. The invention of claim 1 wherein said first scale and said second scale are 24-hour scales.

11. The invention of claim 1 further comprising:

a plurality of time-setting pins movable along the one of said scales utilized for the setting of switching-times.

12. An improved electrical timer wherein said electrical timer is of a type including a first time scale portion marked with indicia for setting timer switching times and a second time scale portion located adjacent said first time scale portion, said second time scale portion marked with indicia for setting time-of-day, and wherein said improvement comprises:

a window located over one of said first and said second time scale portions and through which a portion of said one of said first and said second time scale portions is exposed.

13. The invention of claim 12 wherein said first time scale portion and said second time scale portion are concentric to each other.

14. The invention of claim 12 wherein said first time scale portion and said second time scale portion are located on a dial.

15. The invention of claim 12 wherein said first time scale portion and said second time scale portion are located on a surface next to each other.

16. The invention of claim 12 wherein said window is located in a cover.

17. The invention of claim 12 wherein said window is located over said second time scale portion.

18. An electrical timer of the type used to automatically turn on and off a supply of electricity by setting of desired switching times on an interface thereof, said electrical timer comprising:

a housing;

a dial rotatably mounted in said housing;

a first timing scale located on said dial;

a second timing scale located on said dial; and a cover located adjacent said dial and covering at least a portion of said dial including at least a portion of said second timing scale;

wherein said cover has a window through which a portion of said second timing scale is viewable.

19. The timer of claim 18 wherein said cover is non-rotatably mounted relative to said housing.

20. The timer of claim 18 wherein said first timing scale is a switching-times scale and said second timing scale is a time-of-day scale.

21. The timer of claim 18 wherein said first timing scale is a switching-times scale and is located concentric with said second timing scale.

22. The timer of claim 18 wherein said first timing scale is a switching times scale and further wherein said first timing scale is located adjacent a circumferential edge of said dial.

* * * * *